United States Patent [19]

Goodman

[11] Patent Number: 5,063,715

[45] Date of Patent: Nov. 12, 1991

[54] WALL SYSTEM AND EQUIPMENT TILE THEREFOR

[75] Inventor: Steven F. Goodman, Wyoming, Mich.

[73] Assignee: Herman Miller, Inc., Zeeland, Mich.

[21] Appl. No.: 479,973

[22] Filed: Feb. 14, 1990

[51] Int. Cl.[5] ..... A47B 47/00

[52] U.S. Cl. ..... 52/36; 211/192; 248/245

[58] Field of Search ..... 211/193, 192, 191; 248/245, 244, 243, 242; 52/510, 511, 35

[56] References Cited

U.S. PATENT DOCUMENTS

| | | | |
|---|---|---|---|
| 2,261,956 | 11/1941 | Brownlie et al. . | |
| 2,980,037 | 4/1961 | Elsner . | |
| 3,054,511 | 9/1962 | Erismann . | |
| 3,414,224 | 12/1968 | Robilliard et al. . | |
| 3,572,626 | 3/1971 | Bertschi . | |
| 3,601,432 | 8/1971 | Fenwick . | |
| 3,730,108 | 5/1973 | Stroh . | |
| 3,733,755 | 5/1973 | Butler | 52/241 X |
| 3,966,158 | 6/1976 | Boundy . | |
| 4,013,254 | 3/1977 | Boundy et al. . | |
| 4,048,768 | 9/1977 | Good | 248/243 X |
| 4,106,738 | 8/1978 | Kostecky . | |
| 4,154,419 | 5/1979 | Breidenbach | 248/243 |
| 4,198,913 | 4/1980 | Haworth et al. . | |
| 4,205,815 | 6/1980 | Sauer et al. . | |
| 4,222,542 | 9/1980 | Wilson | 211/192 X |
| 4,421,289 | 12/1983 | Sturm . | |
| 4,515,494 | 5/1985 | Robilliard et al. . | |
| 4,550,893 | 11/1985 | Wiersema | 248/243 X |
| 4,671,481 | 6/1987 | Beard . | |
| 4,679,368 | 7/1987 | Pettinga | 211/192 |
| 4,685,255 | 8/1987 | Kelley . | |

*Primary Examiner*—John E. Murtagh

*Attorney, Agent, or Firm*—Varnum, Riddering, Schmidt & Howlett

[57] ABSTRACT

A wall system having a rigid frame with vertically spaced slots, tiles removably mounted to the frame and an equipment tile having a hollow protruded portion for storing equipment therein. The equipment tile is mounted to the frames through a retention clip and a hanger clip which mount to the vertical hanging intelligence on the wall frame. The retention clip is mounted to the tile through a slotted connection for limited vertical movement of the retention clip with respect to the tile so that the retention clip can be pulled downwardly with respect to the frame without movement of the tile with respect to the frame to seat the retention clip in the frame slots and to secure the tile on the frame. A locking flange on the retention clip is pivotably mounted to a hanger portion thereof for locking the retention clip onto the frame. The equipment tile is adapted to be mounted beneath a transaction surface which precludes upward movement of the tile with respect to the frame.

13 Claims, 4 Drawing Sheets

WALL SYSTEM AND EQUIPMENT TILE THEREFOR

BACKGROUND OF THE INVENTION

1. Field of the Invention

This invention relates to wall systems, especially for commercial use. More particularly, the invention relates to a wall system having rigid frames to which tiles are removably mounted thereto wherein clips mount the tiles to the frame and seat in slots without vertical movement of the tiles with respect to the frames.

2. State of the Prior Art

In Kelley et al. U.S. Pat. No. 4,685,255 (issued Aug. 11, 1987), there is disclosed a work space management system in which a rigid framework formed of rigid rectangular frames are joined together at the edges thereof to form a work area. Modular tiles are removably mounted to the frame through hanger clips at the bottom of the tiles and spring clips at the top of the tile. The tiles are easily removable by pulling outwardly on the upper portions of the tiles. This mounting system contemplates that the tiles will be mounted on both sides of the frame.

Work stations formed in accordance with the Kelley et al. work space management system can have varying heights, including a seated privacy height which, for example, can function as a nursing station. Typically, a work surface is mounted to the frames at desk height. It is advantageous to support machines such as computers and word processors on the work surface. It has been found that further space for such machinery can be obtained by eliminating a tile from the inside surface and by further providing a hollow tile with a bulging outer surface on the outside of the frame. Thus, the machine can extend through the frame and into the hollow portion of the outside tile, thereby providing additional space for the machine on the work surface.

When there is a tile on only one side of a frame, there is a chance that pushing against the tile from the other side will dislodge the tile from the frame unless the tile is securely mounted or locked onto the frame. Thus, the spring clip mounting disclosed in the Kelley et al. '255 patent may not be satisfactory for mounting equipment tiles to the frames.

The frames typically have vertical rows of slots at either side thereof for mounting accessories onto the frame. It is possible to mount the tile to the frames with conventional hook clips, as disclosed, for example, in the Fenwick U.S. Pat. No. 3,601,432 (issued Aug. 24, 1971) or the Boundy et al. U.S. Pat. No. 4,013,254 (issued Mar. 22, 1977) with the hooks in the clips seating in the slots in the frame. However, the equipment tiles are frequently mounted directly beneath and in confronting relationship with transaction surfaces which extend out over the equipment tiles. Using the conventional hook-type clips for mounting the tiles to the frame would require the tiles to be moved downwardly with respect to the frames to seat the hooks behind webs in the frames. This function could be accomplished if the transaction surfaces are mounted onto the frames subsequent to the mounting of the equipment tiles onto the frames. However, it is desirable to remove and replace the equipment tiles on many occasions after the frames, including the transaction surfaces, have been completely assembled. Thus, use of the conventional hooks would require the transaction surfaces to be removed each time that the equipment tile is removed.

Alternatively, the equipment tiles would have to be of a slightly smaller height to accommodate the vertical movement of the tiles on the frames. This different size would be undesirable in that it would create a gap between the transaction surface and the equipment tile and would also create an undesirable gap between the equipment tile and another tile above the equipment tile in the event that the equipment tile is not mounted directly beneath a transaction surface.

SUMMARY OF THE INVENTION

According to the invention, there is provided a wall system having a rigid frame with vertically spaced slots and tiles removably mounted to the frame wherein at least one tile is mounted to the frame at least in part through a retention clip having a hanger portion with hooks to mount to the frame through the slots wherein the retention clip is mounted to the tile for limited vertical movement between a frame-engaging and non-engaging position. The movability of the retention clip on the tile provides a mechanism by which the retention clip hanger portion can be positioned in the frame slots and can be pulled downwardly with respect to the frame without movement of the tiles with respect to the frame to seat the retention clip and thus the tile on the frame.

The retention clip preferably has a locking flange pivotably mounted to the hanger portion thereof for movement between an unlocking position and a locking position. The locking flange has a tab adapted to fit within one of the slots so that the clip can be locked in seated position on the frame.

The wall system can have a transaction surface mounted on top of the frame and extending outwardly over the one tile with the one tile being mounted in confronting relationship directly below the transaction surface to prevent upward movement of the tiles with respect to the frames.

The clip is preferably mounted to the tiles through slotted openings in the clip and pins mounted in the slots and to the tile. Alternatively, slotted openings can be provided in the tiles in lieu of the slotted openings in the clip.

Preferably, the tiles are mounted also to the frames through hanger clips which are mounted to the tile and are adapted to fit within the frame slots and at least partially support the tiles on the frame. In a preferred embodiment, the hanger clips are positioned on a bottom portion of the tile and the retention clips are positioned on an upper portion of the tile so that the tile can be first mounted on the frame through the hanger clips at an acute angle to the frame and then rotated to the frame so that the hanger portion hooks extend through the frame slots. Preferably, the tile is pan-shaped with an outwardly formed protrusion and a hollow interior to provide cover for a machine element mounted inside the frame.

Further, according to the invention, there is provided an equipment tile adapted to be removably mounted to a rigid frame having vertically spaced slots therein. The tile comprises a body portion and at least one retention clip having hanger portions with hooks to mount the tile to the frame slots. Means mount the clip to the tile body for limited vertical movement with respect thereto whereby the tile can be mounted on the frame slots by sliding the clip downwardly with respect to the tile body while maintaining the tile relatively fixed with respect to the frame.

BRIEF DESCRIPTION OF THE DRAWINGS

The invention will now be described with reference to drawings in which.

DETAILED DESCRIPTION OF THE DRAWINGS

Figure 1:
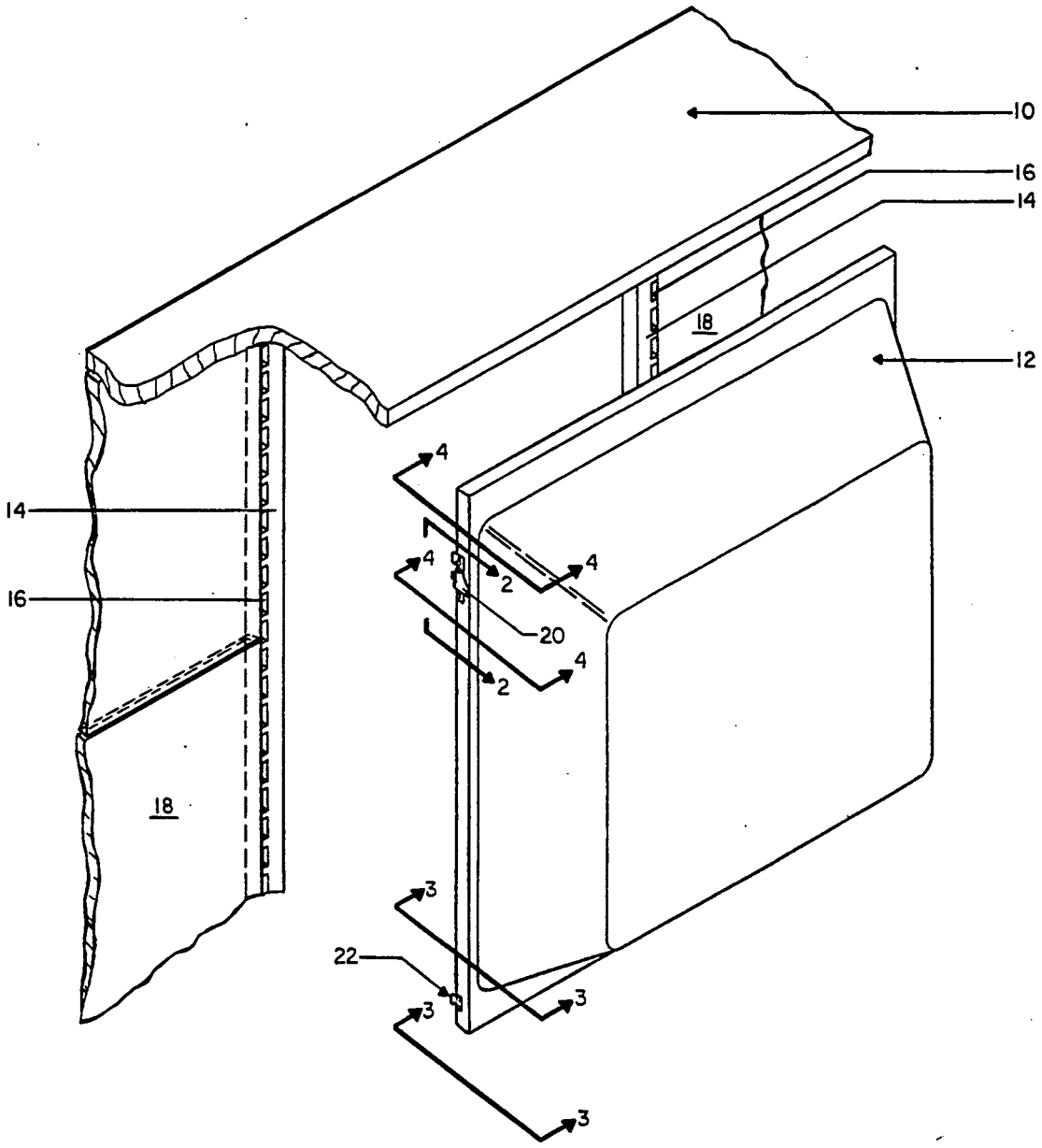
FIG. 1 is a perspective view of an equipment tile according invention and a partial wall having a transaction surface and a standard.

Referring now to FIG. 1, there is shown an equipment tile 12 in exploded relationship to a wall 18 having a transaction surface 10 mounted to a top portion thereof. The wall is constructed in accordance with the wall structure disclosed in U.S. Pat. No. 4,685,255, issued Aug. 11, 1987, and generally has a rigid rectangular framework and modular tiles removably mounted to the faces of the frames. Vertical frame members 14 have vertical rows of slots 16 by which the tile 12 is mounted to the wall 18 through a retention clip 20 and a bottom hanger clip 22 both of which are mounted to the side edges of the tile 12. Typically, these slots are used to mount brackets to support shelves, cabinets and the like to the frames. Ordinarily, the tiles are mounted to other holes (not shown) in the frame through a hook and spring clip. However, in the case of the equipment tile, it is desirable to lock the tile in place to prevent inadvertent dislodgement from either side of the wall. It is contemplated that the other side of the wall would be open for placement of a machine into the bulged portion of the tile. Although only one side of the tile 12 is shown, the other side of the tile 12 has a retention clip which is a mirror image of the clip 20 and a hanger clip which is a mirror image of the clip 22. Equipment tiles 12 can be used to complete the finish of the wall panel or to cover equipment mounted on work surfaces on the opposite side of the panel. The tiles according to the invention include bottom hanger clips 22 and retention clips 20, all of which mount to an equipment tile 12 and engage the slots 16 in the vertical standards 14 for mounting. The equipment tiles 12 are generally rectangular pan-shaped with an outward bulge or protrusion. The inside of the equipment tiles 12 are hollow so that equipment can project through the frame and into the hollow portion of the tile 12.

Figure 2:
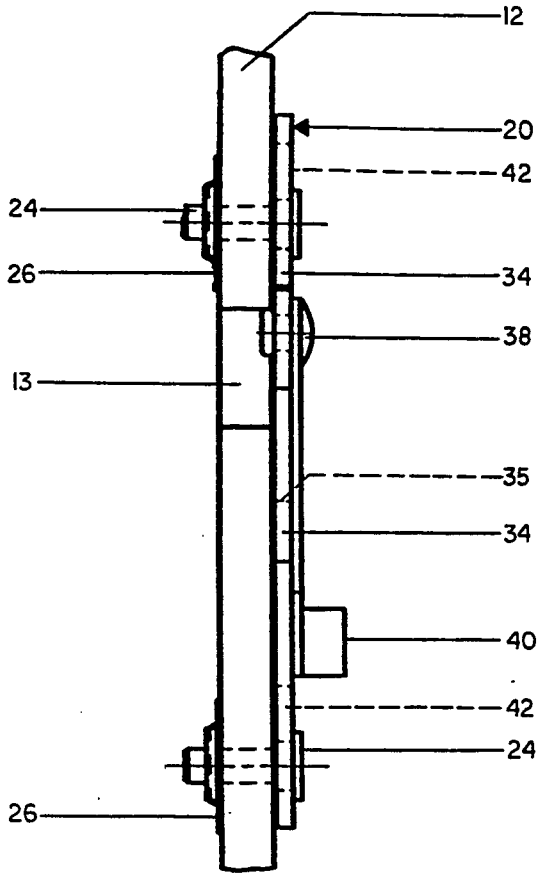
FIG. 2 is a partial view taken along lines 2—2 of FIG. 1.
Figure 4:
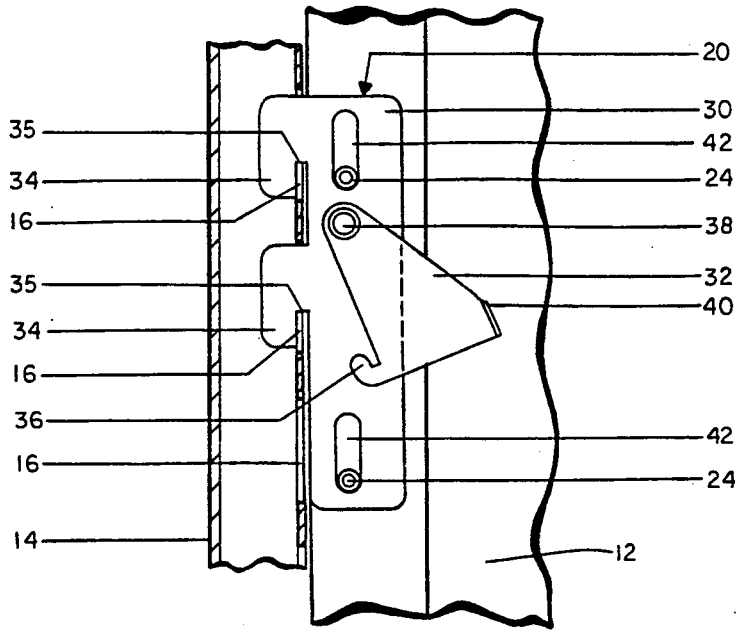
FIG. 4 is a partial view, taken along line 4—4 of FIG. 1, a retention clip inserted into slots in a standard.

Referring to FIGS. 2 and 4, the retention clip 20 is shown mounted to a side edge of an equipment tile 12 by means of two mounting pins in the form of rivets 24 which are retained by retaining rings 26. The mounting pins or rivets 24 are mounted such that they penetrate and engage, without binding, oval shaped mounting holes 42 in the retention clip 20 which provide the retention lip 20 with a limited amount of vertical movement relative to the equipment tile 12 between a non-engaging position, shown in FIG. 4 and a frame-engaging position shown in FIGS. 5 and 6. This action is more fully explained below. As shown in FIG. 2, the side edge of the tile 12 has a slot 13 to accommodate the vertical movement of the clip 20.

Figure 3:
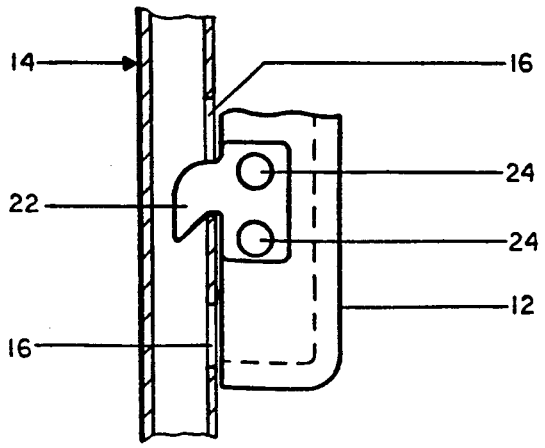
FIG. 3 is a partial view, taken along line 3—3 of FIG. 1.

Turning to FIG. 3, the bottom hanger clip 22 is shown in use engaging the slots 16 in a vertical frame member 14. It is rigidly mounted to an equipment tile 12 using two sets of mounting rivets 24 and retaining rings 26. The bottom hanger clip 22 is shaped to fit snugly into the slots 16 in the vertical frame member 14.

Turning to FIG. 4, the retention clip 20 is shown positioned in slots 16 in a vertical frame member 14 in preparation for engagement. The retention clip 20 comprises a hanger portion 30 and a locking flange 32. The hanger 30 has a pair of hanger hooks 34 which are designed to pass through the slots 16 in the vertical frame member 14 and seat behind the webs between the slots. The hooks 34 define an inner surface 35. The hanger portion 30 also has a pair of oval shaped mounting holes 42 which are used to mount the retention clip 20 to an equipment tile. The locking flange 32 is pivotably mounted to the hanger 30 by means of a rivet 38, which pivotably mounts the locking flange 32 to the hanger portion 30 for movement between an unlocked position, shown in FIGS. 4 and 5 and a locking position, shown in FIG. 6. The locking flange 32 has a finger tab 40 (see also FIG. 2) for an easier grip during pivoting, and a locking flange tab 36 which fits within a slot 16 in the vertical frame member 14 when the locking flange 32 is pivoted inward to the locking position.

In operation, an equipment tile 12 is mounted by first positioning the bottom hanger clips 22 into the appropriate slots 16 in the vertical frame member 14. This initial step is done with the top of the tile tilted slightly away from the wall panel 18. The bottom hanger clips 22 are shaped to allow a limited amount of rotation of the top of the tile away from the wall by pivoting the tile about the bottom hanger clips 22 during mounting.

Figure 5:
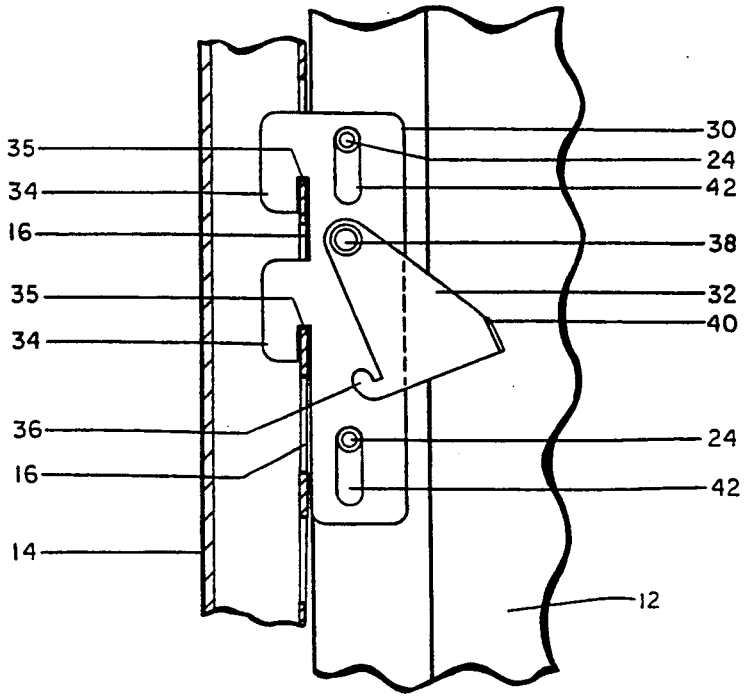
FIG. 5 is a view like FIG. 4 showing the clip pulled down and hooks engaging the slots.
Figure 6:
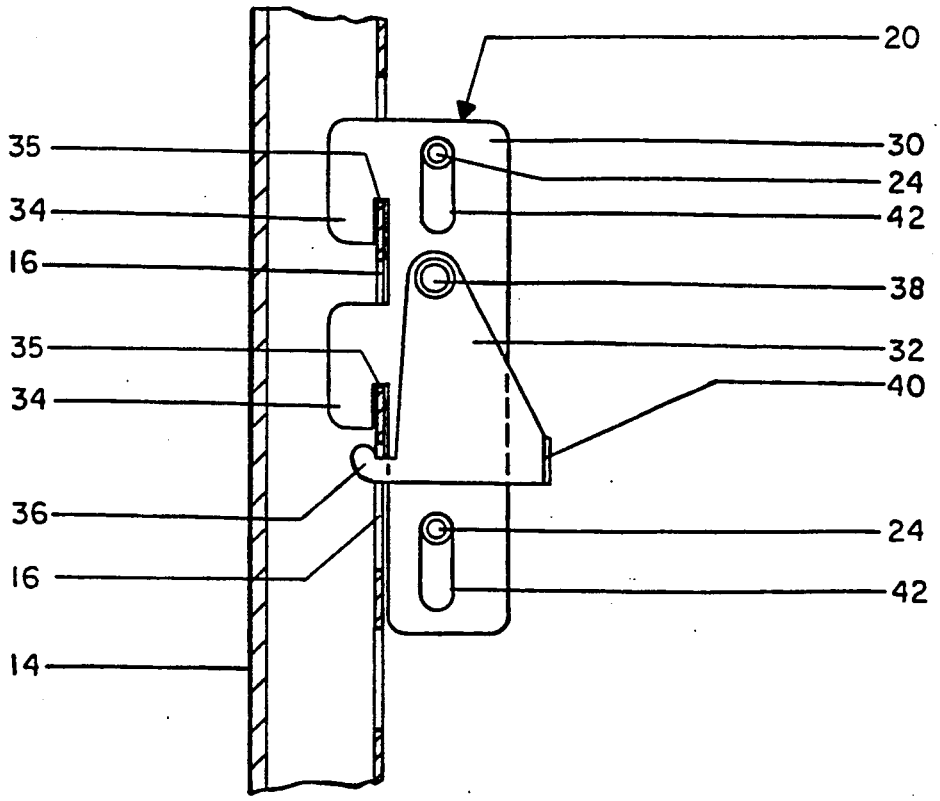
FIG. 6 is a view like FIG. 4 showing a locking flange of the clip rotated inwardly to engage the slots in the standard.

Reference is made to FIGS. 4–6, which illustrate the operation of the retention clip 20 during mounting of an equipment tile 12. The retention clip 20 is slidably mounted on the equipment tile 12 by means of the oval shaped mounting holes 42 and the mounting rivets 24 which affords the retention clip 20 a limited amount of vertical movement relative to the equipment tile 12. After the bottom hanger clips 22 are positioned within the slots 16 in the vertical frame member 14, the retention clip 20 is positioned on the equipment tile 12 in the uppermost position on the equipment tile 12.

With the retention clips 20 in the uppermost position, the top of the tile is then rotated toward the wall 18 so that the hanger hooks 34 enter slots 16 on the vertical frame member 14 as shown in FIG. 4. The retention clips 20 are then moved down to the position shown in FIG. 5 by pulling down on the clips until surface 35 seats on the web portion of frame 14 and the hanger hooks 34 are seated in the frame slots. This action seats the hanger hooks 34 in the slots 16 to prevent horizontal movement of the retention clip 20 and the equipment tile 12 with respect to the frame members 14. To complete the mounting process, the locking flanges 32 are rotated inward to the locking position so that the locking flange tabs 36 seat within a slot on the vertical frame member as shown in FIG. 6. The retention clip 20 is thus blocked from moving vertically in the slots 16 on the vertical frame members 14 and therefore cannot be dislodged from it.

By slidably mounting the retention clip 20 to an equipment tile 12 by means of the oval shaped mounting holes 42 and the mounting rivets 24, the equipment tile 12 can be mounted directly below a transaction surface 10 without removing the transaction surface 10. Without the sliding action of the retention clip 20 relative to the equipment tile 12, the entire tile must be slid down to seat the hanger hooks 34 in the slots 16 during mounting. This action may not be possible when mounting the tile 12 directly below a transaction surface 10, where the top edge of the equipment tile 12 contacts the bottom of the transaction surface 10 when the tile is properly mounted.

While the invention is described in connection with a preferred embodiment and one contemplated use, it is not intended to be limited to a particular embodiment or use. On the contrary, all alternatives and uses are intended to be covered as may be included within the spirit and scope of the invention as defined by the appended claims.

I claim:

1. A wall system having a rigid frame with vertically spaced slots and tiles removably mounted to the frame, the improvement which comprises:

at least one tile mounted to the frame at least in part through a retention clip having a hanger portion with hooks to mount to the frame through the slots;

hanger clips separate from the retention clip and immovably mounted on said tile for supporting said tile on said frame;

means mounting the retention clip to the tile for limited vertical movement between frame-engaging and non-engaging positions when the hanger clips are seated on the frame;

a locking flange pivotably mounted to the retention clip hanger portion for movement between an unlocking position and a locking position, the locking flange having a tab adapted to fit within one of the frame slots;

the shape and placement of the locking flange is such that the locking flange tab is seated in a frame slot when the hanger portion hooks are seated in the frame slots and the locking flange is in the locking position;

whereby the tile can be first supported by the frame through the hanger clips, the retention clip hanger portion is then positioned in the frame slots and can be pulled downwardly with respect to the frame without movement of the tiles with respect to the frame to seat the retention clip on the frame and thereby retain the tile on the frame, and whereby the retention clip can be locked in seated position on the frame.

2. A wall system according to claim 1 wherein the clip mounting means comprises slotted openings in the clip and pins mounted in the slotted openings and to the tile.

3. A wall system according to claim 2 wherein the tile is pan-shaped with an outwardly formed protrusion and a hollow interior.

4. A wall system according to claim 3 wherein the hanger clips are mounted at a lower portion of the tile and the retention clips are mounted at an upper portion of the tile, whereby the tile can be first mounted to the frame through the hanger clips and at an acute angle thereto and thereafter rotated to the frame at which the hooks of the retention clip extend through the slots in the frame.

5. A wall system according to claim 1 wherein the frame slots form vertical rows for mounting brackets and the like.

6. A wall system according to claim 1 wherein the hanger clips are mounted at a lower portion of the tile and the retention clips are mounted to an upper portion of the tile, whereby the tile can be first mounted to the frame through the hanger clips with the tile at an acute angle thereto and thereafter rotated to the frame at which the hooks of the retention clip extend through slots in the frame.

7. In a tile adapted to be removably mounted to a rigid frame having vertically spaced slots therein, the tile comprising a body portion and at least one retention clip having a hanger portion with hooks to mount the tile to the frame slots, the improvement which comprises:

hanger clips separate from the retention clips and immovably mounted to said tile for supporting said tile on said frame;

means mounting the retention clip to the tile body for limited vertical movement with respect thereto whereby the tile can be mounted on the frame slots by sliding the clip downwardly with respect to the tile body when the hanger clips are seated in frame slots while maintaining the tile relatively fixed with respect to the frame;

a locking flange pivotably mounted to the hanger portion for movement between an unlocking position and a locking position, said locking flange having a tab adapted to snugly fit within a frame slot, the shape and placement of the locking flange is such that the locking tab is seated in a frame slot when the hanger portion hooks are seated in the frame slots and the locking flange is in the locking position.

8. A wall system according to claim 7 wherein the hanger clips are mounted at a lower portion of the tile and retention clips are mounted to an upper portion of the tile, whereby the tile can be first mounted to the frame through the hanger clips and positioned at an acute angle thereto, and thereafter rotated to the frame at which the hooks of the retention clip extend through slots in the frame.

9. A wall system according to claim 7 wherein the hanger clips are mounted at a lower portion of the tile and the retention clips are mounted to an upper portion of the tile, whereby the tile can be first mounted to the frame through the hanger clips and positioned at an acute angle thereto, and thereafter rotated to the frame at which the hooks of the retention clips extend through the slots in the frame.

10. A wall system having a rigid frame with vertically spaced slots and tiles removably mounted to the frame, the improvement which comprises:

at least one tile mounted to the frame at least in part through a retention clip having a hanger portion with hooks to mount to the frame through the slots;

hanger clips separate from the retention clip and immovably mounted on said tile for supporting said tile on said frame;

the retention clip having a slotted opening and a pin mounted to the tile and received in the slotted opening to mount the retention clip to the tile for limited vertical movement between frame-engaging and non-engaging positions when the hanger clips are seated on the frame;

whereby the tile can be first supported by the frame through the hanger clips, the retention clip hanger portion is then positioned in the frame slots and can be pulled downwardly with respect to the frame without movement of the tiles with respect to the frame to seat the retention clip on the frame and thereby retain the tile on the frame.

11. A wall system according to claim 5 wherein the tile is pan-shaped with an outwardly formed protrusion and has a hollow interior.

12. A wall system having a rigid frame with vertically spaced slots and tiles removably mounted to the frame, the improvement which comprises:

at least one tile mounted to the frame at least in part through a retention clip having a hanger portion with hooks to mount to the frame through the slots;

hanger clips separate from the retention clip and immovably mounted on said tile for supporting said tile on said frame;

means mounting the retention clip to the tile for limited vertical movement between a frame-engaging and non-engaging position when the hanger clips are seated on the frame;

a transaction surface mounted on the top of a frame and extending outwardly over said one tile, and said one tile is mounted in confronting relationship directly below the transaction surface to prevent upward movement of the tile with respect to the frame;

whereby the tile can be first supported by the frame through the hanger clips, the retention clip hanger portion is then positioned in the frame slots and can be pulled downwardly with respect to the frame without movement of the tiles with respect to the frame to seat the retention clip on the frame and thereby retain the tile on the frame.

13. A wall system according to claim 12 wherein the clip mounting means comprises slotted openings in the clip and pins mounted in the slotted openings and to the tile.

* * * * *